United States Patent [19]

Langfield et al.

[11] 4,320,924

[45] Mar. 23, 1982

[54] RECIPROCATED CONCRETE SURFACER MEMBER WITH SHIELDED SPRING RETURN

[75] Inventors: Edward R. Langfield, Glen Rock; James L. Hile, Montville; David L. Hird, Pompton Lakes, all of N.J.

[73] Assignee: Elco International, Elmwood Park, N.J.

[21] Appl. No.: 150,609

[22] Filed: May 16, 1980

[51] Int. Cl.[3] ..... B28D 1/26

[52] U.S. Cl. ..... 299/37; 299/69; 404/133; 125/41

[58] Field of Search ..... 299/37, 69; 173/121; 404/133; 125/40, 41

[56] References Cited

U.S. PATENT DOCUMENTS

| | | | |
|---|---|---|---|
| 2,559,012 | 7/1951 | Davis et al. | 173/121 |
| 2,628,599 | 2/1953 | Wilson et al. | 173/121 X |
| 3,545,554 | 12/1970 | Bardwell | 175/414 X |
| 3,810,676 | 5/1974 | Clarke | 299/37 |

FOREIGN PATENT DOCUMENTS

| | | | |
|---|---|---|---|
| 2855805 | 6/1979 | Fed. Rep. of Germany | 404/133 |

*Primary Examiner*—William F. Pate, III

*Attorney, Agent, or Firm*—Ralph R. Roberts

[57] ABSTRACT

A scabbler apparatus having a conventional reciprocated rod is provided with a bit secured to a shank member. A compression spring is adapted to urge the shank and rod upwardly while motive means is provided to drive the rod, shank and bit toward the surface of concrete, rock and the like and against the bias of the spring. A protective retainer and an exclusionary means is provided. This exclusionary means may be a boot, a wiper ring and with or without a one-way valve means. The compression spring is retained at its lower end by a support shelf, usually an inwardly formed flange of the retainer. A washer or ring engages or is carried by the shank of the bit and engages the top end of the spring to urge the shank, the attached bit and the reciprocated rod upwardly.

15 Claims, 8 Drawing Figures

RECIPROCATED CONCRETE SURFACER MEMBER WITH SHIELDED SPRING RETURN

BACKGROUND OF THE INVENTION

1. Field of the Invention

With reference to the classification of art as established in and by the United States Patent Office this invention is believed to be found in the general class entitled, "Road Structure—Process and Apparatus" (Class 404) and in the subclass therein entitled, "Apparatus—Tamping Means" (subclass 133) and in the subclass entitled, "Apparatus with means for comminuting of earth or road surface in situ".

Also of note is the general class entitled, "Mining or in Situ Disintegration of Hard Material" (class 299) and the subclass entitled, "Hard Material Disintegrating Machines-Planer-type cutter" (subclass 32).

2. Description of the Prior Art

The concept of providing a reciprocated driver with a concrete surfacer bit is not new. A spring return for lifting the downwardly moved bits or surfacer members is also well known. The protecting of these reciprocated parts and the springs used therewith have been a big problem since much of the concrete and rock resurfacing causes dust and/or slurry to be brought to and into the reciprocated part containing the spring member resulting in the abrasive wear of this apparatus. In some, if not all, of the prior art devices containing extreme conditions cause excessive wear and replacement of worn parts to be necessary in a matter of a few hours. Since this replacement is not only costly but also removes a tool from a use operation this wear and repair is undesirable. The Applicant realizes this problem and inexpensively protects these moving members to the extent that unwanted abrasive dust and/or slurry are excluded from this apparatus.

In a careful review of the art the following patents are noted: U.S. Pat. No. 3,366,420 to YOUNG as issued Jan. 30, 1968 which shows a concrete scabbler with the bit 37 carried and reciprocated by and with a piston rod 30; U.S. Pat. No. 2,884,842 to SCHMITZ as issued on May 5, 1959 and shows a rotary shaft 12 which reciprocates rod 31. Spring 33 is retained in housing 2 with sleeve 30 providing a shield of the rod 31; U.S. Pat. No. 2,949,909 to MACCHIONI et al. shows an electromagnetic device with a spring return and with a cup or housing 42 shown as retaining spring 45 in FIG. 7. Also of note is U.S. Pat. No. 3,160,216 to ORMES as issued Dec. 8, 1964. In FIG. 4 of this patent the spring 70 is carried in a housing 50 open to the elements and particularly to the dust of removed cement and/or rock.

The Applicant does not know or believe that the problem of wear as produced by cement dust and/or particles, rock dust and/or particles which enter and produce excessive wear on the reciprocated components of scabblers has been studied to the extent needed for a solution to this problem. The scabblers presently available and used prior to this invention usually expose the spring and bit shank to the accumulation of abrasive dust and rapid wear is the result. Many of the shanks, springs and associated components also operate in wet conditions as the scabbler and/or the elements engaging the concrete rock and the like operate with a water or dampening assist. The resulting wet accumulation forms a slurry and the like which accumulates on the scabbler parts resulting in accelerated wear.

SUMMARY OF THE INVENTION

This invention may be summarized, at least in part, with reference to its objects. It is an object of this invention to provide, and it does provide, an improved retainer for a concrete scabbler bit and shank in which the spring return and bit shank are shielded from unwanted contact with the abrasive dust or slurry developed as a result of the destruction of the top surface of the concrete and/or rock.

It is a further object to provide, and it does provide, a positive retainer in which the spring is retained and operates with and in an unrestrained manner. The spring, shank of the bit and restraining protector shield are encased so as to prevent unwanted entry of dust and/or slurry. The reciprocated shank is protected by a wiper, a resilient boot or a one-way arrangement of flapper-type valves and all may be used with compatible threaded mounting of the bit on the reciprocated shank.

In brief, the present invention pertains to the protection and extension of service of the reciprocated shank portions of the scabbler and a protection of the spring is now provided to return the bit to its upper condition. The reciprocating bit is usually actuated with and by pneumatic pressure but this is not to preclude the use of electric or hydraulic power to actuate the scabbler apparatus. Conventionally a scabbler apparatus is provided for the removal of a surface such as concrete and/or rock. The removal is usually less than an inch but may be more. The bit is usually of steel with projecting portions of very hard material such as carbide. This bit is reciprocated at a determined speed and the bit face strikes and penetrates the to-be-removed surface.

The scabbler bit is usually returned to its "up" or "in" condition by a spring. In many of the prior art devices there is insufficient protection to the bit shank, the spring and/or the sleeve in which the shank moves and in general the dust and/or slurry causes undue and rapid wear of these exposed members. In the invention, to be more fully described, there is provided an exclosure that insures that the movable members and the spring are protected from the dust and/or slurry of cement or rock. The spring is utilized as a compression spring and is compressed in use for its full length. The outer protective member is secured to the frame of the apparatus and through a wiper, a resilient boot and/or one-way flapper valves, the dust and/or slurry of concrete and rock is excluded from the inner and reciprocating components.

In addition to the above summary the following disclosure is detailed to insure adequacy and aid in understanding of the invention. This disclosure, however, is not intended to cover said inventive concept no matter how it may later be disguised by variations in form or additions of further improvements. For this reason there has been chosen specific embodiments of the scabbler bit, spring and enclosure as adopted for use in the extending reciprocating member and showing a preferred means for dust and slurry protection during use. These specific embodiments have been chosen for the purposes of illustration and description as shown in the accompanying drawings wherein:

BRIEF DESCRIPTION OF THE DRAWINGS

FIG. 1 represents a side view, partly in section, and diagrammatic and showing an improved retaining and shielding means for a scrabbler bit as moved in a downward driving condition by a powered means and returned by a spring, this improved retainer shielding and protecting the spring and shank from unwanted contamination with cement, dust and the like;

In the following description and in the claims various details are identified by specific names for convenience. These names are intended to be generic in their application. Corresponding reference characters refer to like members throughout the several figures of the drawings.

DESCRIPTION OF THE EMBODIMENT OF FIG. 1

Figure 1:
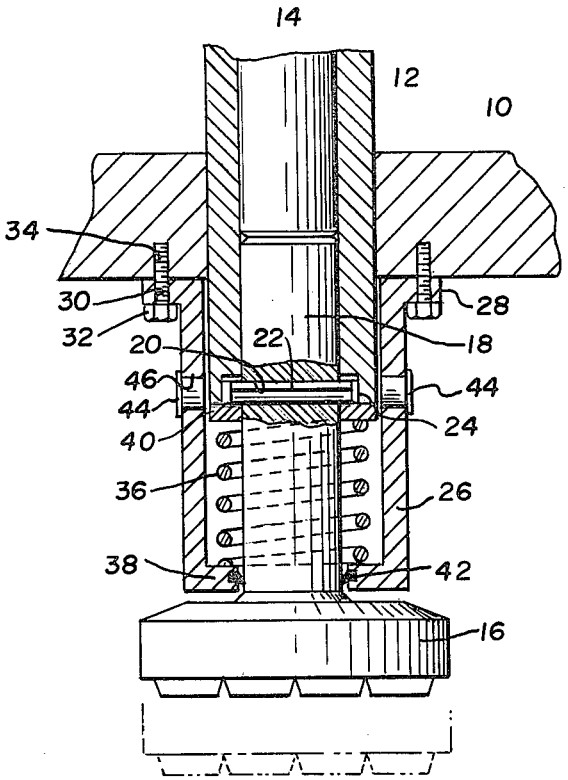

Referring next to the drawings and in particular to FIG. 1, there is a diagrammatic representation of a typical lower portion of a scabbler in which a base 10 carries one or more reciprocating devices. As shown, a pneumatic cylinder 12 is such a device and is secured in this base 10. A piston rod 14 is reciprocably carried in the lower portion of this cylinder. A valve means, not shown, intermittently actuates this cylinder to move it downwardly. A pad or bit, generally identified as 16, includes a shank 18 which is also slidable in the piston rod portion of this cylinder. A transverse hole 20 is sized to receive a pin 22. Said pin contemplated to be used in this hole is a roll pin since it accommodates hole variations. A recess or counterbore 24 is formed in the lower portion of the cylinder 12. A metallic retainer 26 is shown as tubular in shape with both ends open. The upper end of said retainer has a flange 28 in which a plurality of through holes 30 are provided. Bolts or cap screws 32 are mounted in and extend through these holes and into threaded apertures 34 formed and provided in the base 10.

A compression spring 36 is shown with its lower end carried by and engaging a lower inturned flange 38 of the retainer 26. A washer 40 engages the upper end of compression spring 36 and urges the pad or bit 16 upwardly against the downward thrust of the piston rod 14. A seal or wiper 42 is disposed in and is carried by the retainer 26. This seal or wiper is conventionally of plastic such as Nylon or Teflon (TM's of duPont). Other seals or wipers that exclude the dust and/or slurry developed in the removal of the surface material may also be used. Also shown in this FIG. 1 are plugs 44 which are inserted into access holes 46 in the metallic retainer 26. These plugs provide means for excluding unwanted dust or slurry from the inside of the retainer 26. These plugs are sufficiently resilient to provide a tight and retaining fit in the holes 46. Conventionally these plugs are of plastic or rubber-like material.

USE AND OPERATION OF SCABBLER OF FIG. 1

The reciprocating piston rod 14 moves the pad or bit 16 downwardly against the force of spring 36. The downward stroke is always the same and the depth of penetration is adjusted by raising and lowering base 10. The spring 36 shown is a compression spring with all turns subject to like forces. Springs used in other scabblers are often tension springs with some of the turns not used. The shank 18 has a transverse hole 20 formed therein and a roll pin 22 is mounted therein to retain and provide the upper stop and shoulder for washer 40 and spring 36. The retainer 26 is bolted in position by cap screws 32. The spring 36, at its lower end, is supported by the inturned flange 38 of the retainer 26. The wiper or seal 42 engages the shank 18 to prevent dust or slurry from entering the interior of the retainer 26 and adversely affecting the operation and longevity of the shank 18, the spring 36 and the lower guide portion of the cylinder 12.

ALTERNATE EMBODIMENT OF FIG. 2

Figure 2:
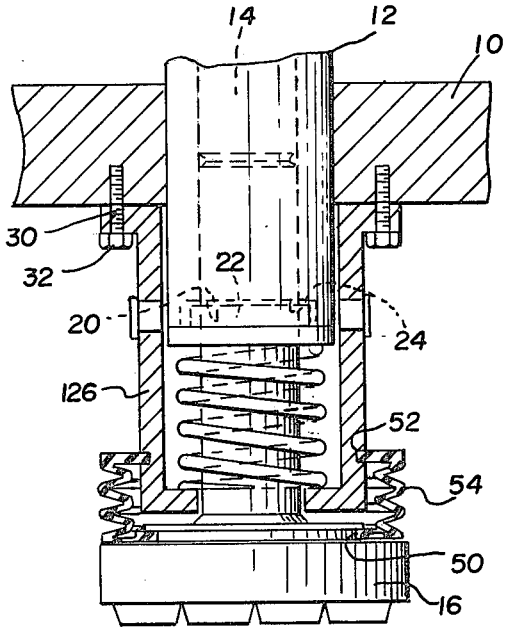
FIG. 2 represents a side view, partly in section, and diagrammatic and in the manner of FIG. 1 this improved retainer also having retaining means both on the outer sleeve and the scabbler bit and on this retaining means an expansible, resilient boot.

Referring next to the drawings and the embodiment of FIG. 2, there is depicted more-or-less the apparatus of FIG. 1 but with minor changes for the exclusion of dust and/or slurry. As depicted, a base 10; cylinder 12; piston rod 14; pad 16; shank 18; transverse hole 20; retaining pin 22; counterbore 24; metallic retainer 26 and holes 30 with cap screws 32 therethrough are the same as above described. The intermediate upper outer portion of pad 16 is formed with a mounting or retaining groove 50. The retainer 26 is also provided with a groove 52. A resilient boot 54 is mounted in these grooves 50 and 52. Preferably this boot is of accordion configuration. FIG. 2 depicts the bit or pad 16 as in its upper position. The piston rod 14 is at its upper extent and the pad is moved downwardly by the force on the piston rod 14. The boot is expanded and contracted with the movement of the pad as it performs the scabbler action. This boot seals the inside of the retainer as the pad is cycled up and down.

OPERATION OF THE EMBODIMENT OF FIG. 2

The use and operation of the apparatus of FIG. 2 is very similar to that of FIG. 1, but the sealing of the interior of the retainer employs a boot, rather than the seal or wiper, which engages and cleans the shank 18 of the pad 16. After the retainer 26 and reciprocating components within this retainer have been mounted, as in FIG. 1 above, the boot 54 is mounted in the appropriately formed grooves 50 and 52. The use of plugs 44 in holes 46 provide the exclusion seal of the upper portion of the retainer shown.

EMBODIMENT OF FIG. 3

Figure 3:
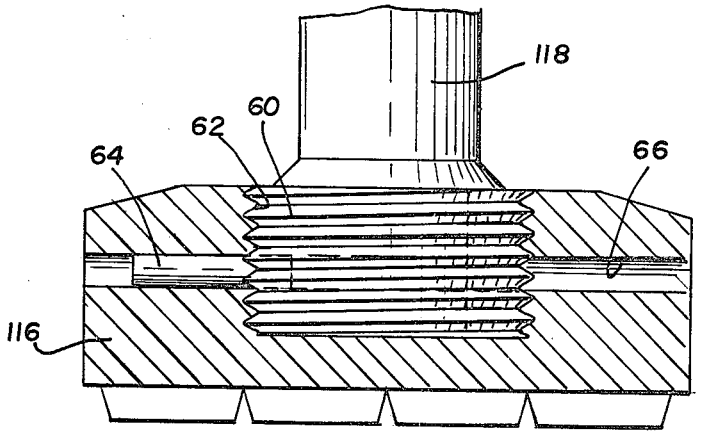
FIG. 3 represents a side view showing in particular the attaching of the scabbler bit to the reciprocating shank by a compatibly formed thread, a transverse pin or screw is provided to insure that the mounted bit remains in place on the reciprocated shank.
Figure 7:
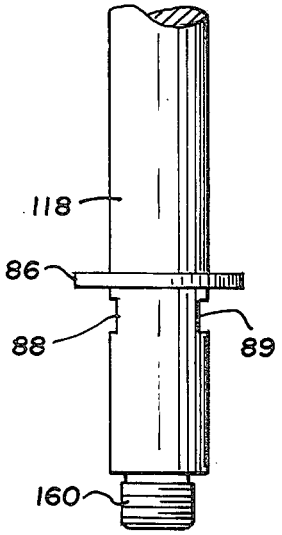
FIG. 7 represents a side view, partly diagrammatic, and showing an alternate construction of the shank of a reciprocated bit, and a spring engaging ring carried with and by this shank.
Figure 8:
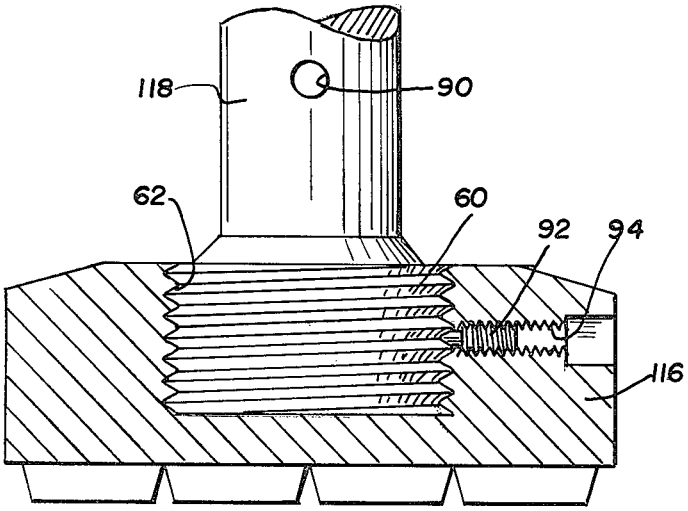
FIG. 8 represents an enlarged side and fragmentary view much like FIG. 4 but with the male threads engaged by a plastic tipped set screw.

Referring next to the embodiment of FIG. 3 it is to be noted that the shank of the pad or bit may be formed with a thread for removably mounting the bit or pad. A shank 118 is formed with a threaded end 60. This threaded end portion is screwed onto a compatibly formed thread 62 in the upper end of a pad or bit identified as 116. In its mounted condition this threaded assembly is retained by a retaining pin or screw 64. This screw or pin 64 is carried in a transverse hole 66 and if a screw, this hole is threaded. For non-deforming of the threads on threaded end 60 a flat or milled recess 68 may be provided at a selected portion of these threads. This pin or screw is carried in the transverse hole 66 formed in the upper or large body of the pad or bit 116. The mounting may be completed and then through the hole 66 a drill bit may be used to form a through hole in the shank. A roll pin can then be inserted into the bit and shank with removal of this pin being by a drift pin. A hole or flat as seen in FIGS. 7 and 8 may be provided to enable the shank to be engaged for removal of the bit from the shank.

ASSEMBLY AND USE OF THE EMBODIMENT OF FIG. 3

The assembly of the pad 116 to shank 118 is a matter of inserting and turning the threaded end 60 into the compatibly formed threaded portion 62 on the end of the shank. After assembly it is very desirable that the pad 116 does not become loose from the shank 118. The inserted retaining screw or pin 64 insures that the assembled members remain in this assembled condition until disassembly is desired. To disassemble, pin 64 is removed after which the pad 116 is removed from the shank 118 by unscrewing. A new pad 116 can then be used on and with shank 118 and reassembly proceeds as above.

EMBODIMENT OF FIG. 4

Figure 4:
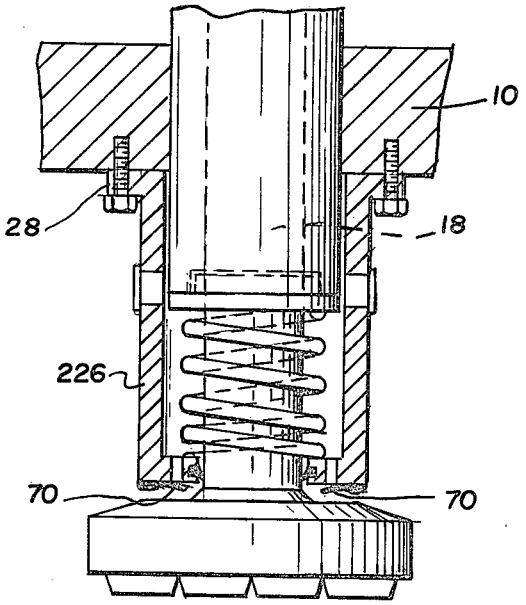
FIG. 4 represents a side view showing yet another alternate embodiment of the improved retainer and providing one-way vent means for expelling the air within the shield.

Referring next to the embodiment of FIG. 4, it is to be noted that the retainer of FIG. 1 may be provided with one-way flapper valves. As shown, the retainer 26 has been altered to employ one-way valve means. A retainer now identified as 126 has one or more one-way flapper valves 70 which are adapted to each close and cover a lower hole 72 formed in the lower portion of this retainer which is now identified as 226. These valves are adapted to allow the free flow of air in one direction (outwardly) when and as the piston rod 14 and washer 40 are moved downwardly. Any and all air that is or reaches a pressure higher than atmospheric pressure is discharged through these vents. These plugs that are normally mounted in holes 46 have been changed to one-way valves 74 which are also adapted to allow the free flow of air outwardly. When air pressure inside the retainer or a portion of the retainer is greater than atmospheric pressure the one-way valves close to prevent air from entering. The upper portion of the retainer contains the hole 20 for the placing of the pin 22 and may also have a like or similar flapper valve 70.

USE AND OPERATION OF FIG. 4

The one-way flapper valves 70, as depicted, are designed to allow a flow of air from the interior to the exterior. The valves are each designed to allow air flow in only one direction and since the exterior air contains dust, and/or slurry the valve is designed to close when the interior air is less than atmospheric. The scabblers usually have pneumatic cylinders with pressurized air used to move this cylinder. Most of these pistons do not employ rings so a small amount of air leaks past and into the retainer so that a one-way release of air is often desirable.

It is to be noted that the several embodiments show a retainer with an outer, upper, mounting flange 28 that is bolted to the base 10. This is not to suggest that alternate means of mounting cannot and may not be employed. The changing of the apring return to a compression spring and the use of a washer for the retaining of the upper extent of the spring permits the full use of a spring without the undue distortion of any or all coils. The lower retention of the spring may be by the retainer or other means that is in association with a retaining of the lower end of the spring. The sealing of the retainer and the reciprocating shank 18 is desirable so that dust, dirt and/or slurry is prevented from entering the interior of the retainer.

EMBODIMENT OF FIGS. 5 AND 6

Figure 5:
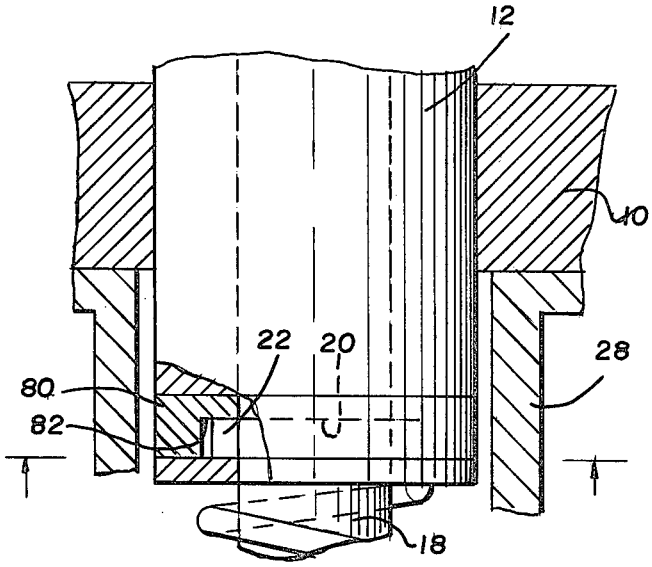
FIG. 5 represents a sectional, side view of the scabbler and showing an alternate means of adapting an existing cylinder for retaining a compression spring washer.
Figure 6:
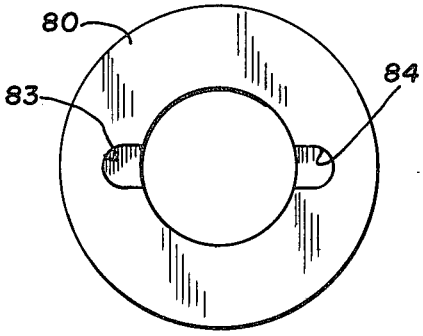
FIG. 6 represents a transverse view looking at an affixed retainer ring, said view taken on the line 6—6 of FIG. 5 and looking in the direction of the arrows.

In FIGS. 5 and 6 there is shown an alternate means for mounting a pin 22 in a transverse aperture 20 formed in the shank 18. In this alternative embodiment a cylinder 12 is not altered but an additional end member 80 is affixed to this downwardly directed end of the cylinder. This additional member is a ring-like member having the same or sililar inside and outside diameters as cylinder 12. This ring-like end member 80 may be formed with a counterbore 82 or may have end milled grooves 83 and 84 to provide retaining shoulders for the ends of pin 22. This ring-like member is secured in the desired position and attitude by silver solder, brazing or epoxy. When and where the shank 18 is free to turn in this cylinder 12 then a counterbore 82, as in FIG. 4, is formed and provided in this ring.

EMBODIMENT OF FIG. 7

In FIG. 7 a shank 118 is formed with a ring 86 which may be integral with the shank 118 or may be secured thereto by brazing, solder, epoxy or the like. This ring acts as the washer 40 in FIGS. 1 and 4. Flats 88 and 89 or a pin hole 90 as in FIG. 8 may be used to secure this shank to a bit member. This ring portion 86 is sized to be slidable within a retainer housing 26 such as is shown in FIG. 1.

It is also to be noted that this showing has the threaded end 160 which is reduced in diameter and therefore a compression spring 36 may be slid along its lower diameter. The lower and upper diameters may not be the same but the upper diameter is compatible in the cylinder 12. The ring portion 86 is adapted to retain the upper end of spring 36 while a seal or wiper ring 42, as in FIG. 1, is adapted to wipe the lower shank portion. A boot 54, as in FIG. 2, can also be provided.

EMBODIMENT AS IN FIG. 8

Referring next and finally to FIG. 8, the embodiment of FIG. 4 is depicted but with a set screw 92 carried in a threaded aperture 94 that is substantially normal to the axis of the compatibly formed thread 62. This set screw is provided with a NYLON (TM duPont) tip that prevents deforming the male threads 62 of the shank. Also of note is pin hole 90 which is formed in this shank and provides means for the insertion of a drift pin, not shown, to prevent turning of the shank while removing the bit end.

It is to be noted that the metallic retainer 26 is shown as secured to the base 10 by cap screws 32 but this is not to preclude the securing of the retainer to the cylinder 12 by means such as epoxy cement, screws, clamps and the like. The securing of the retainer is a matter of design choice but fast and inexpensive repair and replacement is contemplated. The transverse hole 94 of FIG. 8 contemplates a non-destructive tapped set screw but a "DUTCHMAN" pin or similar securing can be provided. A hole 90 in the shank 18 may be provided as long as this hole is above any seal or wiper 42 or other means. Flats 88 and 89 on the shank for the gripping by jaws of a wrench is also shown. The construction and provision of one-way valves is a matter of choice as these valves provide only an integrity of the inside of the retainer from unwanted dust, dirt and/or slurry.

The outwardly formed flange 28 is normally a circular configuration but may be wing portions that are discontinuous. The lower inwardly configured flange 38 is normally a circular configuration but segmental portions may be provided. The retainer can be made as a molding of metal or tough plastic. The outer and/or inner surface may be irregular in configuration if desired, but regular diameters are believed easier to manufacture.

Terms such as "up", "down", "bottom", "top", "front", "Back", "in", "out" and the like are applicable to the embodiments shown and described in conjunction with the drawings. These terms are merely for the purposes of description and do not necessarily apply to the position in which the scabbler may be constructed or used.

While particular embodiments of the scabbler bit retainer are shown and described it is to be understood the invention is not limited thereto since modifications may be made within the scope of the accompanying claims and protection is sought to the broadest extent the prior art allows.

What is claimed is:

1. A scabbler for removing a surface portion of concrete, rock and the like and having a reciprocating bit with an outer downwardly directed portion adapted to act on said surface, said scabbler having a cylinder in which a reciprocated rod is movable, said scabbler including:

(a) a base member disposed to accept and retain at least one cylinder in a determined orientation with the cylinder extending below the base a determined amount;

(b) a bit with an attached shank of a reduced and substantially constant diameter, said shank having one end adapted to be engaged and moved by said reciprocated rod;

(c) a retainer adapted to enclose nearly all of that shank of the bit when said bit is at its upward extent;

(d) means for securing the retainer to a fixed member and provide external protection of the attached bit shank from dust, dirt, slurry and the like;

(e) a compression spring disposed around the shank of the bit and when mounted and in operating condition adapted to urge the bit shank toward the reciprocated rod;

(f) a washer slidable on said shank of the bit with said washer restrained from further upward movement along said shank of the bit by a retaining pin insertable in and carried in an aperture formed in said shank, said washer providing means for retaining an upper end of said spring and urging said shank upwardly;

(g) means for retaining a lower end of said spring to the lower end of the retainer, and (h) means for sealing the retainer at its lower end so as to provide external protection of the bit shank as it is reciprocated, this seal excluding the shank and interior of the retainer from dust, dirt, slurry and the like.

2. A scabbler as in claim 1 in which the retaining pin is prevented from moving in said aperture by a counterbore formed in the downwardly directed end of the cylinder, this counterbore of a size to engage and retain the ends of said inserted pin.

3. A scabbler as in claim 2 in which there is also at least one through aperture formed in and through the wall of the lower end of the cylinder, said aperture providing an access for inserting said retaining pin in the shank of the bit, and a plug is mounted in said access aperture to exclude entrance of dust, dirt, slurry and like material through said access aperture and into the lower scabbler apparatus.

4. A scabbler as in claim 1 in which the means for sealing the lower end of the retainer is a wiper ring removably secured in said lower end and with the inner diameter of the wiper sized and adapted to slide on and wipe the shank of the bit as it is reciprocated.

5. A scabbler as in claim 1 in which the means for sealing the retainer at its lower end is a resilient boot which is secured tightly at both ends and is impervious to dust, dirt, slurry, water and combinations thereof, this boot having its lower end secured to that portion of the bit above the engaging surface and below the shank portion encased by the retainer and with the upper end of the boot secured to the outer surface of the retainer at a determined intermediate portion.

6. A scabbler as in claim 5 in which the boot is accordion pleated and at its lower end is secured to and in a groove formed in the bit and at its upper end said boot is secured in a groove formed in the outer surface of the retainer.

7. A scabbler as in claims 4 or 5 in which the retainer is formed with at least one aperture in and through the wall thereof and in the lower portion of the retainer, said aperture providing an access means for inserting said retaining pin in the shank of the bit, and a plug is mounted in said access aperture to exclude entrance of dust, dirt, slurry and like material through said access aperture and into the lower scabbler apparatus.

8. A scabbler as in claim 1 in which the retainer is formed with an outwardly formed flange at its upper end and there is provided means for securing this retainer to said base by said flange and this retainer at its lower end has an inwardly formed flange portion that is sized and adapted to provide a stop and supporting shelf for the lower end of the compression spring.

9. A scabbler as in claim 1 in which at least one aperture is formed in and through the wall of the lower end of the retainer, said aperture providing an access for inserting a retaining pin in the shank of the bit, this access aperture closed with a one-way valve means adapted to pass air that is at greater than atmospheric pressure from the interior of the retainer, and the lower end of the retainer is provided with a passage therethrough and with this passage closed by a one-way valve means, said valve means adapted to pass air that is at greater than atmospheric pressure from the interior of the retainer.

10. A scabbler as in claim 9 in which there is additionally provided means for securing the upper end of the shank by said retaining pin which is prevented from moving longitudinally in said aperture by a counterbore provided in the downwardly directed end of the cylinder, this counterbore of a size to engage and retain the ends of said inserted pin.

11. A scabbler as in claim 10 in which there is additionally provided a wiper ring disposed in and at the lower end of the retainer, said wiper ring removably secured in said lower end and with the inner diameter of this wiper ring sized and adapted to slide on and wipe the shank of the bit as it is reciprocated.

12. A scabbler as in claim 1 in which the bit is formed with a female threaded portion and the shank at its downwardly projecting end is formed with a compatible male thread that provides said attaching means.

13. A scabbler as in claim 12 in which the bit as and when mounted on the threaded end of the shank is retained in said mounted condition by a cross-drilled aperture and a removable means is carried in said cross-drilled aperture.

14. A scabbler as in claim 13 in which the cross-drilled aperture is threaded and the removable means is a set screw with a soft insert and providing a non-mar of the thread of the inserted shank.

15. A scabbler as in claim 12 in which means are provided to allow the shank to be grasped without damage while the bit end is removed.

* * * * *